US009826613B2

(12) United States Patent
Tomita

(10) Patent No.: US 9,826,613 B2
(45) Date of Patent: Nov. 21, 2017

(54) X-RAY TUBE ASSEMBLY AND METHOD FOR ADJUSTING FILAMENT

(71) Applicant: Shimadzu Corporation, Kyoto (JP)

(72) Inventor: Sadamu Tomita, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 39 days.

(21) Appl. No.: 14/896,082

(22) PCT Filed: Jul. 9, 2013

(86) PCT No.: PCT/JP2013/068756

§ 371 (c)(1),
(2) Date: Dec. 4, 2015

(87) PCT Pub. No.: WO2015/004732

PCT Pub. Date: Jan. 15, 2015

(65) Prior Publication Data

US 2016/0128169 A1 May 5, 2016

(51) Int. Cl.

| | |
|---|---|
| ***H05G 1/00*** | (2006.01) |
| ***H05G 1/34*** | (2006.01) |
| ***H01J 35/06*** | (2006.01) |

(52) U.S. Cl.

CPC ..... *H05G 1/34* (2013.01); *H01J 35/06* (2013.01)

(58) Field of Classification Search

USPC ..... 378/98.6, 98.9, 101, 109, 110, 113, 114, 378/115, 121, 122, 129, 134, 136, 137, 378/138, 139

See application file for complete search history.

(56) References Cited

U.S. PATENT DOCUMENTS

| | | | | |
|---|---|---|---|---|
| 4,360,734 A * | 11/1982 | Dietz | H05G 1/66 | 378/114 |
| 6,464,551 B1 | 10/2002 | Lipkin et al. | | |
| 7,722,252 B2 * | 5/2010 | Tang | H05G 1/00 | 378/207 |
| 2002/0126798 A1 * | 9/2002 | Harris | H01J 35/06 | 378/136 |

FOREIGN PATENT DOCUMENTS

| | | | |
|---|---|---|---|
| JP | 02-260354 | | 10/1990 |
| JP | 2000-011854 | A | 1/2000 |
| JP | 2012-015045 | A | 1/2012 |
| JP | 2012015045 | A * | 1/2012 |
| JP | 2015-011871 | A | 1/2015 |
| JP | 2015011871 | A * | 1/2015 |

OTHER PUBLICATIONS

International Search Report for corresponding International Application No. PCT/JP2013/068756 dated Sep. 10, 2013.

* cited by examiner

*Primary Examiner* — Don Wong
(74) *Attorney, Agent, or Firm* — Renner Otto Boisselle & Sklar, LLP

(57) ABSTRACT

An X-ray tube assembly for generating an X-ray, comprises: a filament including a plurality of electric flow paths; and an adjustor configured to adjust at least one of values of current flowing through the plurality of electric flow paths to adjust an electron emission area of the filament.

11 Claims, 7 Drawing Sheets

FIG. 5

| CURRENT VALUE OF A, B | CURRENT VALUE OF C, D | ELECTRON EMISSION AREA |
|---|---|---|
| 6[A] | 3[A] | 0.5[mm] |
| 6.2[A] | 2.8[A] | ... |
| ⋮ | ⋮ | ⋮ |
| 8.8[A] | 0.2[A] | ... |
| 9[A] | 0[A] | 0.75[mm] |

(a)

| CURRENT VALUE OF A, B | CURRENT VALUE OF C, D | ELECTRON EMISSION AREA |
|---|---|---|
| 6[A] | 3[A] | 0.5[mm] |
| 6[A] | 2.8[A] | ... |
| ⋮ | ⋮ | ⋮ |
| 6[A] | 0.2[A] | ... |
| 6[A] | 0[A] | ... |
| 6.2[A] | 3[A] | ... |
| 6.2[A] | 2.8[A] | ... |
| ⋮ | ⋮ | ⋮ |
| 6.2[A] | 0.2[A] | ... |
| 6.2[A] | 0[A] | ... |
| 6.4[A] | 3[A] | ... |
| 6.4[A] | 2.8[A] | ... |
| ⋮ | ⋮ | ⋮ |

(b)

X-RAY TUBE ASSEMBLY AND METHOD FOR ADJUSTING FILAMENT

TECHNICAL FIELD

The present invention relates to an X-ray tube assembly and the method for adjusting a filament. In particular, the present invention relates to the technique of adjusting an electron emission area of a filament having a plurality of electric flow paths.

BACKGROUND ART

A flat plate-shaped filament (also called as a "flat plate-shaped emitter") including four legs for electrical heating will be described as an example of a filament including a plurality of electric flow paths for electric flow. Typical structures of the flat plate-shaped filament will be described with reference to FIGS. 6 and 7. FIGS. 6 and 7 are schematic plan views of the typical flat plate-shaped filaments. FIG. 6 is the flat plate-shaped filament having a rectangular shape, and FIG. 7 is the flat plate-shaped filament having a circular shape.

As illustrated in FIGS. 6 and 7, four legs 102 to 105 for electrical heating are provided at ends of an electron beam emission surface 101 (an electron beam emission surface 101 having a rectangular shape in FIG. 6, and an electron beam emission surface 101 having a circular shape in FIG. 7). Typically, electric flow is made through each of the legs 102 to 105 bent at 90° at the positions indicated by dashed lines in the figures, thereby heating the electron beam emission surface 101. Then, thermal electrons are emitted from the electron beam emission surface 101. The thermal electrons emitted from the electron beam emission surface 101 collide with a positive-electrode target (not shown in the figures) to generate an X-ray.

Of the legs 102 to 105, the legs 102, 103 (indicated by "A" and "B" in the figures) are legs 102, 103 for full lighting, electrical heating, the legs 102, 103 being used for full lighting for large focus. In the full lighting for large focus, power is distributed to heat the entire region of the electron beam emission surface 101 to emit an electron beam. Of the legs 102 to 105, the legs 104, 105 (indicated by "C" and "D" in the figures) are, on the other hand, legs 104, 105 for half lighting, electrical heating, the legs 104, 105 being used for half lighting for small focus. In the half lighting for small focus, power is distributed to heat only a narrower region (see the region hatched using lines obliquely extending toward the upper right side in the figures) than the entire surface of the electron beam emission surface 101 to emit an electron beam.

That is, in the case of heating the entire region of the electron beam emission surface 101, power is distributed through the legs 102, 103 (A, B) for full lighting, electrical heating, thereby heating the entire region of the electron beam emission surface 101. On the other hand, in the case of limiting, for small focus, the electron emission area by partial lighting, power is distributed through the legs 104, 105 (C, D) for half lighting, electrical heating, thereby lighting and heating only the region hatched using the lines obliquely extending toward the upper right side in the figures. In the case of the full lighting, the electric flow path is in the order of A, the base end of A, the base end of D, the base end of C, the base end of B, and B. In the case of the half lighting, the electric flow path is in the order of D, the base end of D, the base end of C, and C. In this manner, the lighting area of the flat plate-shaped filament is adjusted by a change in the electric flow path (see, e.g., Patent Document 1).

CITATION LIST

Patent Document

Patent Document 1: JP-A-2012-015045

SUMMARY OF THE INVENTION

Problems to be Solved by the Invention

However, in the flat plate-shaped filament (the flat plate-shaped emitter) including four legs for electrical heating, there are only two ways including the way of heating the entire region and the way of performing partial lighting. For this reason, a focal dimension is switchable only between two dimensions. If the filament includes a plurality of electric flow paths, the number, other than four, of legs for electrical heating may be provided. Thus, in the case of increasing the number of types of focal dimension as a switching target, four or more legs for electrical heating may be provided. However, this leads to a complicated structure.

The present invention has been made in view of the above-described situation, and is intended to provide an X-ray tube assembly which can provide an optional degree of focus and the method for adjusting a filament.

Solutions to the Problems

The X-ray tube assembly includes a filament including a plurality of electric flow paths, and an adjustor configured to adjust at least one of values of current flowing through the plurality of electric flow paths to adjust an electron emission area of the filament.

The temperature of part of the region of the filament and the temperature of the other part of the region of the filament are properly set in such a manner that at least one of the values of current flowing through the electric flow paths is properly adjusted. Since the current value and the electron emission area are in a non-linear relationship, the electron emission area of the filament can be freely adjusted by adjustment of the current value, and an optional degree of focus between the focus obtained in the case of entire heating and the focus obtained in the case of partial heating can be obtained.

The filament includes first to fourth legs for electrical heating, an outer electron emission surface electrically connected to the first and second legs, and an inner electron emission surface electrically connected to the third and fourth legs and the outer electron emission surface. The adjuster causes current flowing between the first and second legs to flow through the outer electron emission surface, causes current flowing between the first and second legs and current flowing between the third and fourth legs to flow through the inner electron emission surface, and adjusts at least one of the value of current flowing between the first and second legs and the value of current flowing between the third and fourth legs.

Current flowing between the first and second legs and current flowing between the third and fourth legs flow through the inner electron emission surface in the same direction.

The values of current flowing through the electric flow paths are preferably synchronized and adjusted. Needless to say, the current values are not necessarily synchronized with each other, and may be separately adjusted.

Effects of the Invention

According to the X-ray tube assembly and the filament adjustment method of the present invention, the electron emission area of the filament can be freely adjusted in such a manner that at least one of the values of current flowing through the electric flow paths is adjusted, and an optional degree of focus between the focus obtained in the case of entire heating and the focus obtained in the case of partial heating can be obtained.

BRIEF DESCRIPTION OF THE DRAWINGS

FIGS. 5 (*a*) and 5 (*b*) are tables showing the correspondence relationship between an electron emission area and a combination between the value of current flowing through legs for full lighting, electrical heating and the value of current flowing through legs for half lighting, electrical heating.

DESCRIPTION OF EMBODIMENTS

As a result of conducting intensive study to solve the above-described problems, the present inventor (s) has found as follows.

That is, the idea of increasing the number of electric flow paths has been changed, and the present inventor (s) has focused attention on parameters for controlling the distribution paths. Of the parameters for controlling the distribution paths, a filament temperature has been focused. It has been found that in fact, the filament temperature is not uniform in the region subjected to electrical heating, but there is a thermal gradient in such a region. Moreover, it has been also found that an electron emission area is determined according to a non-uniform temperature distribution at a filament.

On the other hand, the value of current of electric flow has been set by switching between ON and OFF. Only the maximum current value in an ON state and a value of 0 [A] in an OFF state have been set. In the view of the thermal gradient at the filament, the value of current of electric flow and the electron emission area have been assumed to be in a non-linear relationship. It has been found that taking advantage of the non-linear relationship between the value of current of electric flow and the electron emission area, the electron emission area can be finely adjusted by fine adjustment of the value of current of electric flow, and therefore, an optional degree of focus can be obtained.

Figure 1:
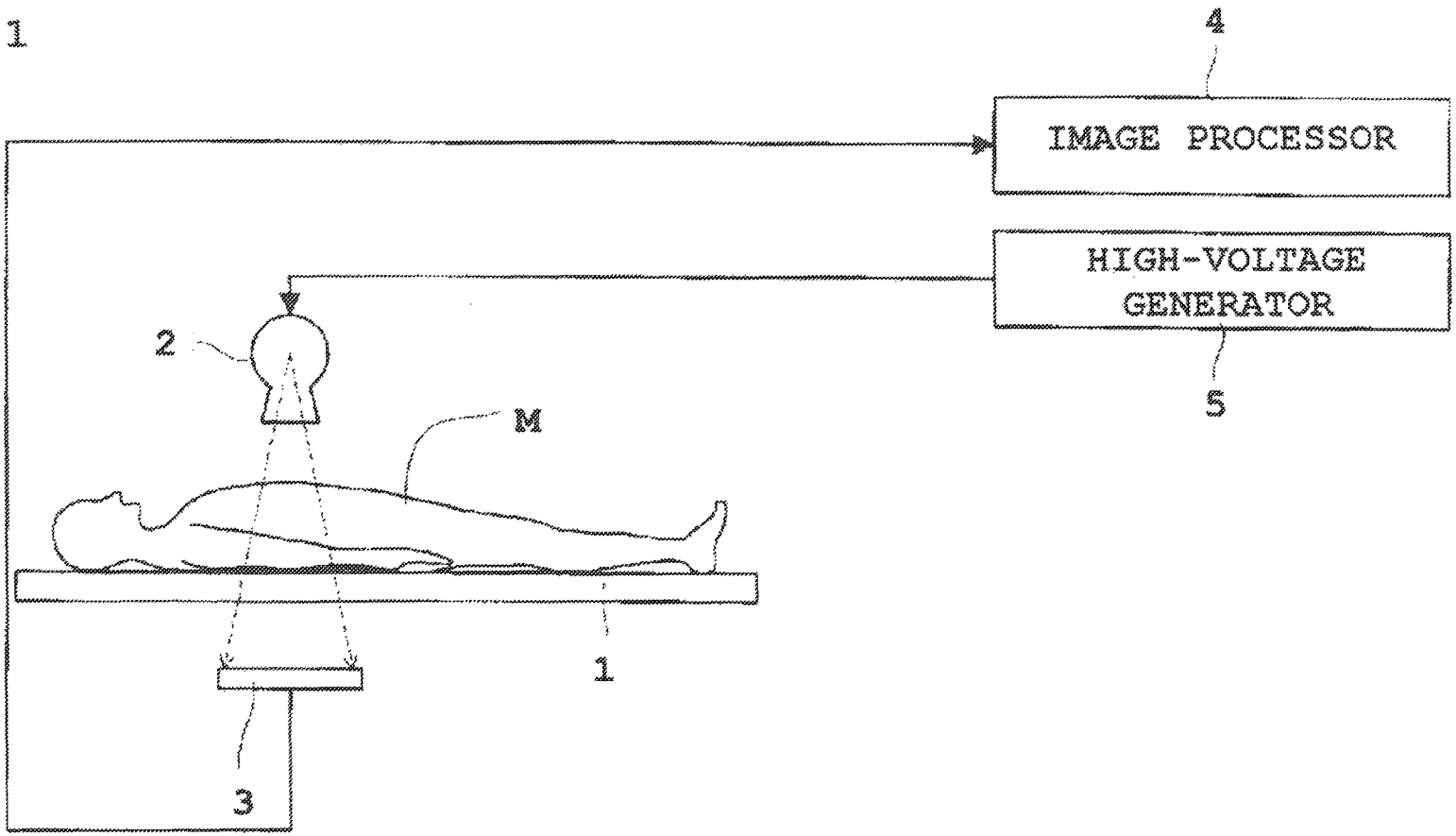
FIG. 1 is a block diagram of an X-ray apparatus of an embodiment.
Figure 2:
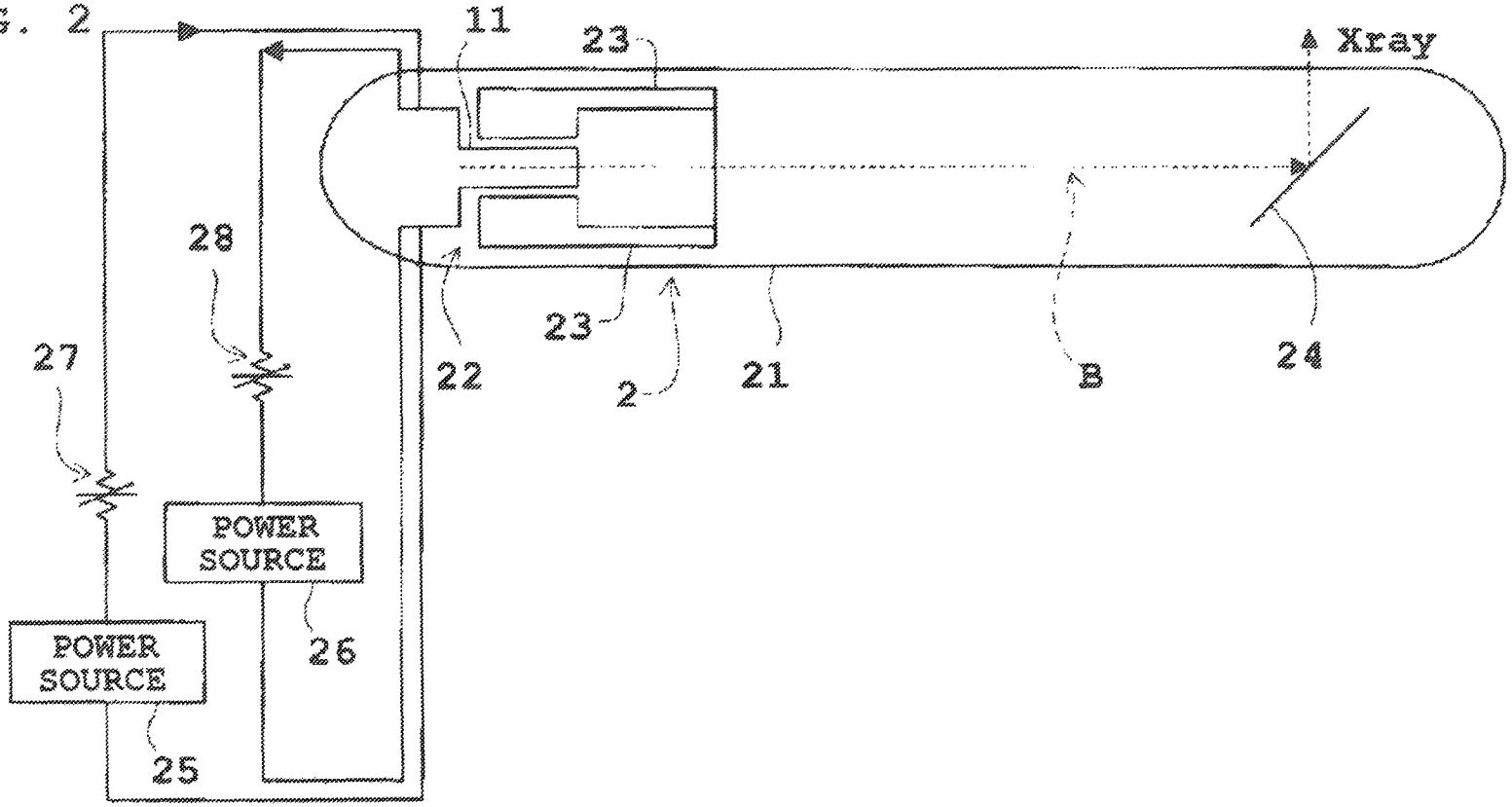
FIG. 2 is a schematic view of an X-ray tube assembly of the embodiment.
Figure 3:
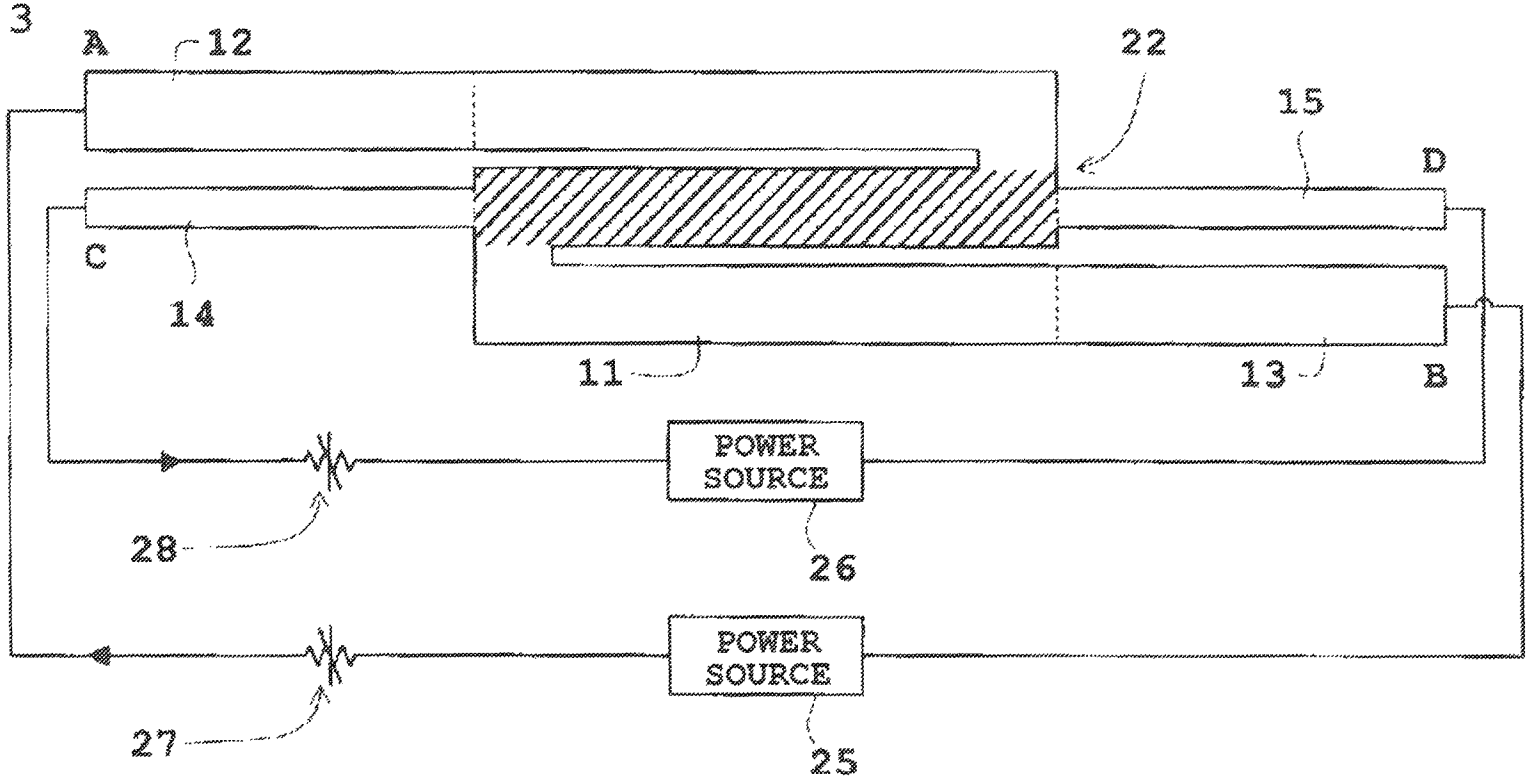
FIG. 3 is a schematic plan view illustrating a flat plate-shaped filament and a peripheral circuit according to the embodiment.
Figure 4:
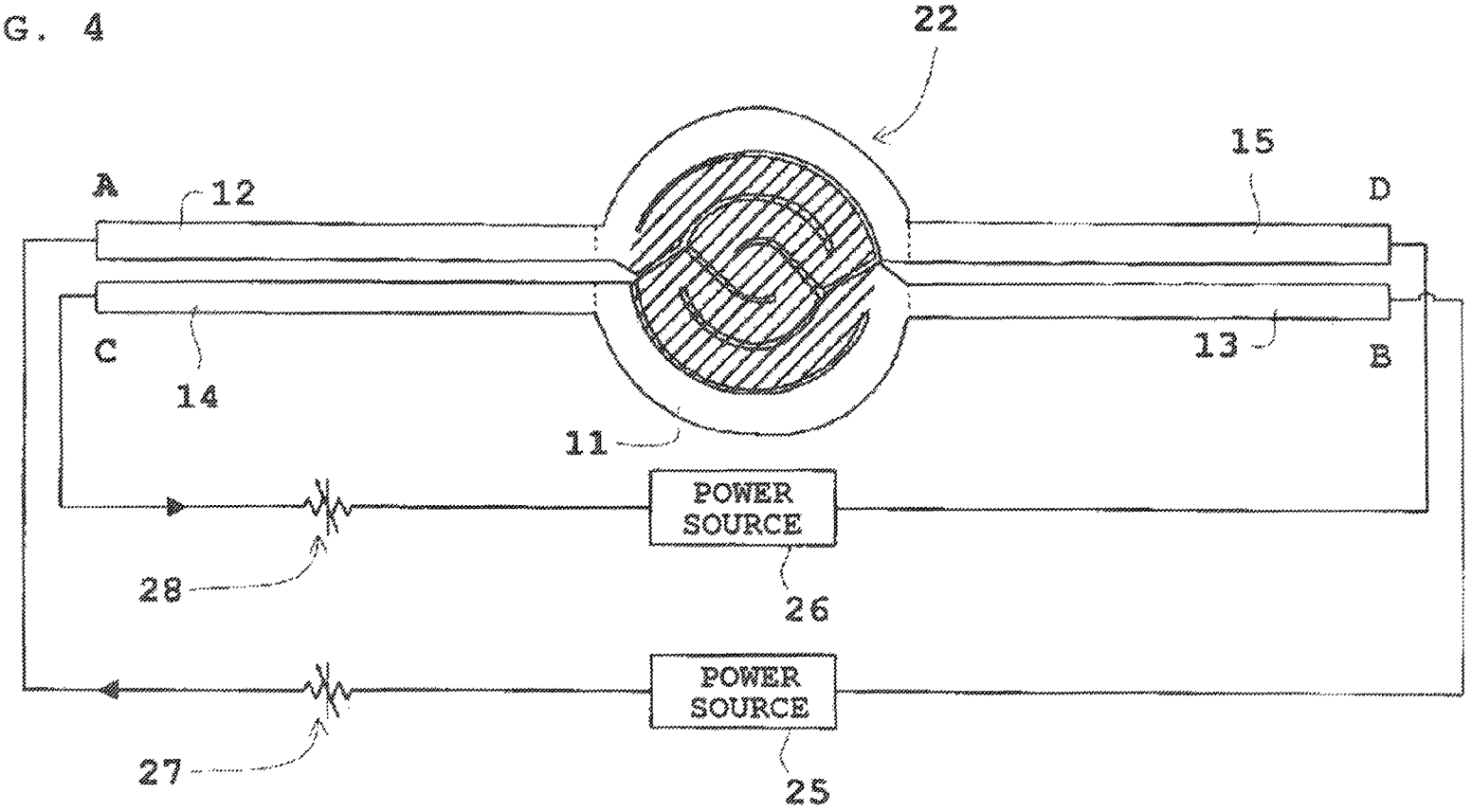
FIG. 4 is a schematic plan view illustrating a flat plate-shaped filament, having a shape different from that of FIG. 3, and a peripheral circuit according to the embodiment.
Figure 6:
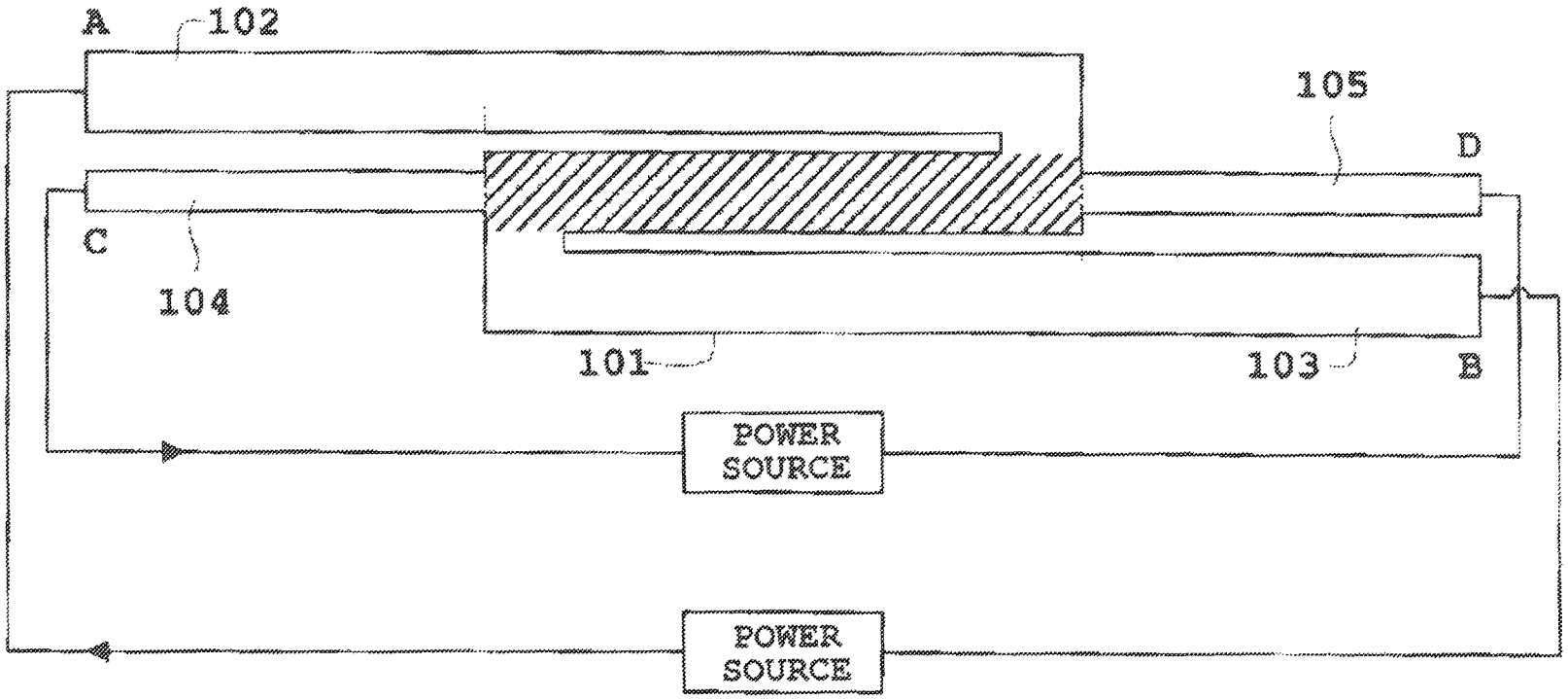
FIG. 6 is a schematic plan view of a typical flat plate-shaped filament.
Figure 7:
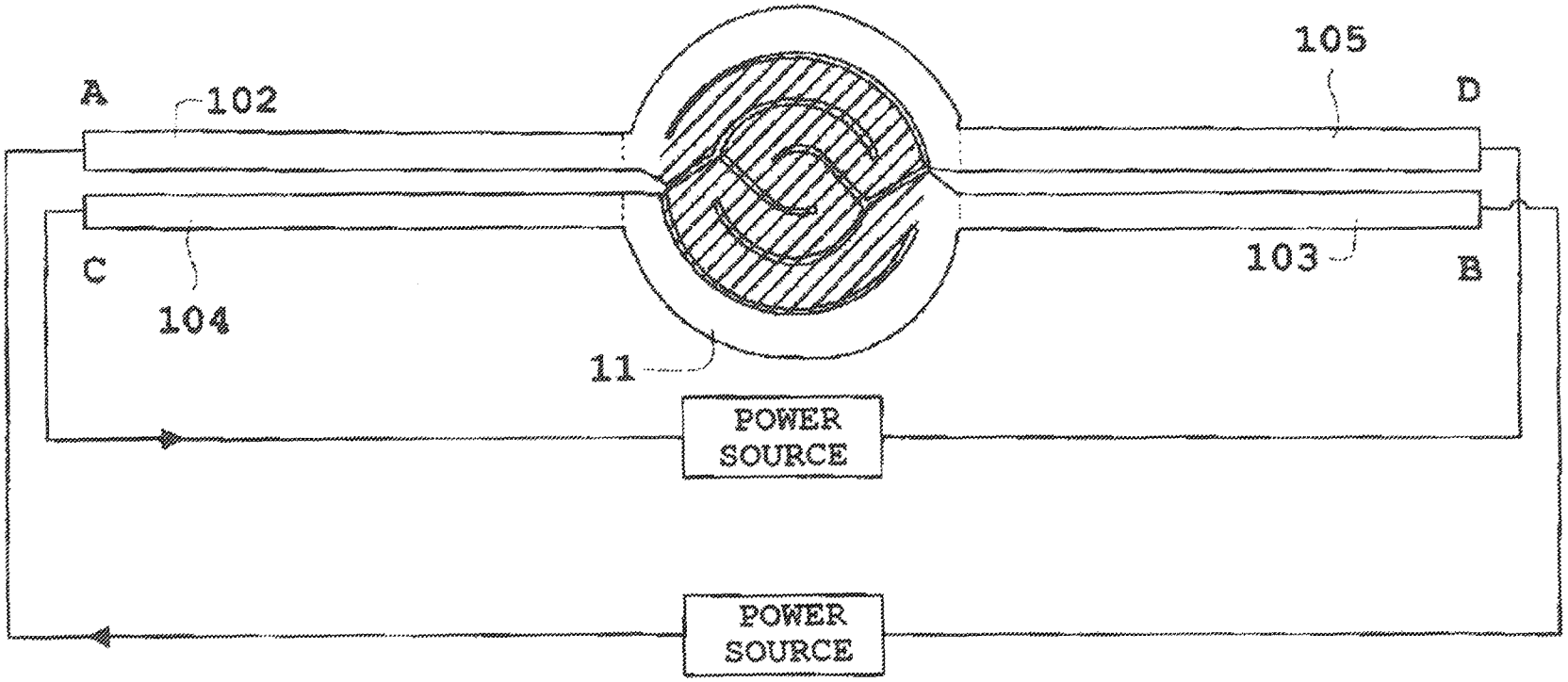
FIG. 7 is a schematic plan view of a typical flat plate-shaped filament having a shape different from that of FIG. 6.

An embodiment of the present invention will be described with reference to drawings. FIG. 1 is a block diagram of an X-ray apparatus of the embodiment, FIG. 2 is a schematic diagram of an X-ray tube assembly of the embodiment, and FIGS. 3 and 4 are each a schematic plan view illustrating a flat plate-shaped filament and a peripheral circuit according to the embodiment. In the present embodiment, the case of using the flat plate-shaped filament for the X-ray tube assembly will be described as an example, and the case of incorporating the X-ray tube assembly into the X-ray apparatus such as an X-ray fluoroscopic apparatus and X-ray equipment will be described as another example.

The X-ray apparatus of the present embodiment includes, as illustrated in FIG. 1, a top panel 1 on which a subject M is placed, an X-ray tube assembly 2 configured to irradiate the subject M with an X-ray, and a flat panel type X-ray detector (FPD) 3 configured to detect an X-ray transmitted through the subject M. Note that the X-ray detector is not limited to the above-described FPD, and examples of the X-ray detector include an image intensifier. The X-ray tube assembly 2 is equivalent to an X-ray tube assembly of the present invention.

The X-ray tube assembly 2 includes an envelope 21, a cathode 22, and an anode 24, the cathode 22 and the anode 24 being housed in the envelope 21. The cathode 22 is formed mainly of a flat plate-shaped filament 11 and focusing electrodes 23. The specific configuration of the flat plate-shaped filament of the present embodiment will be described later with reference to FIGS. 3 and 4. Note that the X-ray tube assembly 2 is not limited to the type of extracting an X-ray in the direction perpendicular to the optical axis of an electron beam B as illustrated in FIG. 2, and may be the type of transmitting an X-ray in parallel with the optical axis of an electron beam B.

In addition, as illustrated in FIG. 2, the X-ray tube assembly 2 includes, at the periphery of the envelope 21, power sources 25, 26 (also see FIGS. 3 and 4) and variable resistors 27, 28 (also see FIGS. 3 and 4). The power sources 25, 26 are not limited. The power sources 25, 26 may be alternating-current sources or direct-current sources. The variable resistors 27, 28 are equivalent to an adjuster of the present invention.

Returning to the description of FIG. 1, the X-ray apparatus further includes an image processor 4 and a high-voltage generator 5. In addition, the X-ray apparatus further includes configurations such as a monitor, a storage medium, and an input section (any of these configurations are not shown in the figure). However, these configurations are not features, or do not relate to the features. The description of such configurations will not be made.

The X-ray tube assembly 2 generates an X-ray to irradiate, with the X-ray, the subject M placed on the top panel 1. The FPD 3 detects the X-ray generated from the X-ray tube assembly 2 and transmitted through the subject M. The FPD 3 is configured such that X-ray detection elements (not shown in the figure) corresponding respectively to pixels are arranged in a two-dimensional matrix. The image processor 4 performs image processing based on the X-ray detected by the FPD 3 to obtain an X-ray image. Specifically, an X-ray image is output in such a manner that pixel values based on the X-ray detected by the X-ray detection elements are associated respectively with the pixels and are arranged. At this point, the image processor 4 performs, for the X-ray image, various types of image processing.

In shooting, the X-ray tube assembly 2 irradiates the subject M with a normal dose of X-ray radiation once, and then, an X-ray image obtained by the image processor 4 is output. In fluoroscopy, the X-ray tube assembly 2 continuously irradiates the subject M with a smaller dose of X-ray radiation than that in shooting, and then, X-ray images obtained by the image processor 4 are continuously output to the monitor (not shown in the figure). Moreover, in tomography, at least one of the X-ray tube assembly 2, the FPD 3, or the subject M is moved. While the X-ray tube assembly 2 or the FPD 3 are moved relative to the subject M, the X-ray tube assembly 2 continuously irradiates the subject M with an X-ray, and reconstruction processing is performed for X-ray images obtained by the image processor 4. Then, a tomographic image is output.

The high-voltage generator 5 provides tube voltage or tube current to the X-ray tube assembly 2 to control the X-ray tube assembly 2 to generate an X-ray. In the present embodiment, the high-voltage generator 5 includes a synchronizing circuit in order to synchronize and adjust the values of current flowing through a plurality of electric flow paths (two electric flow paths in the present embodiment). Specifically, the high-voltage generator 5 simultaneously controls the variable resistors 27, 28 (see FIGS. 2 to 4) to be synchronized with each other, thereby adjusting the value of current flowing through the variable resistor 27 and the value of current flowing through the variable resistor 28. Note that although will be described later, one of the current values may be fixed while only the other current value may be variably adjusted. At least one of the current values may be adjusted.

As illustrated in FIG. 2, the envelope 21 houses the flat plate-shaped filament 11, the focusing electrodes 23, and the anode 24. A window (not shown in the figure) is provided in the envelope 21. Through the window, the X-ray (indicated by "Xray" in FIG. 2) generated by collision of the electron beam B with the anode 24 is, after transmission thereof, extracted to the outside of the envelope 21. The cathode 22 is formed mainly of the flat plate-shaped filament 11 illustrated in FIG. 3 or 4 and the focusing electrodes 23 (see FIG. 2), and is configured to focus, on the anode 24, the electron beam B emitted from an electron beam emission surface of the flat plate-shaped filament 11.

The flat plate-shaped filament 11 has the structure illustrated in FIG. 3 or 4. FIG. 3 illustrates a flat plate-shaped filament having a rectangular shape, and FIG. 4 illustrates a flat plate-shaped filament having a circular shape. Four legs 12 to 15 for electrical heating are provided at ends of the electron beam emission surface (an electron beam emission surface having a rectangular shape in FIG. 3, and an electron beam emission surface having a circular shape in FIG. 4). Electric flow is made through each of the legs 12 to 15 bent at 90° at the positions indicated by dashed lines in the figures, thereby heating the electron beam emission surface. Then, thermal electrons are emitted from the electron beam emission surface. The thermal electrons (see the electron beam B illustrated in FIG. 2) emitted from the electron beam emission surface collide with the anode 24 to generate an X-ray.

Of the legs 12 to 15, the first leg 12 and the second leg 13 (indicated by "A" and "B" in the figures) are legs 12, 13 for full lighting, electrical heating, the legs 12, 13 being used for full lighting for large focus. In the full lighting for large focus, power is distributed to heat the entire region of the electron beam emission surface to emit the electron beam B. Of the legs 12 to 15, the third leg 14 and the fourth leg 15 (indicated by "C" and "D" in the figures) are, on the other hand, legs 14, 15 for half lighting, electrical heating, the legs 14, 15 being used for half lighting for small focus. In the half lighting for small focus, power is distributed to heat only a narrower region (an inner electron emission surface) (see the region hatched using lines obliquely extending toward the upper right side in the figures) than the entire surface of the electron beam emission surface to emit the electron beam B. The legs 12, 13 are electrically connected to an outer electron emission surface (a region other than the region hatched using the lines obliquely extending toward the upper right side), and the legs 14, 15 and the outer electron emission surface are electrically connected to the inner electron emission surface.

That is, in the case of heating the entire region of the electron beam emission surface, power is distributed through the legs 12, 13 (A, B) for full lighting, electrical heating, thereby heating the entire region of the electron beam emission surface. On the other hand, in the case of limiting, for small focus, the electron emission area by partial lighting, power is distributed through the legs 14, 15 (C, D) for half lighting, electrical heating, thereby lighting and heating only the region hatched using the lines obliquely extending toward the upper right side in the figures. In the case of the full lighting, the electric flow path is in the order of A, the base end of A, the base end of D, the base end of C, the base end of B, and B. In the case of the half lighting, the electric flow path is in the order of D, the base end of D, the base end of C, and C. In this manner, the heating area (lighting area) of the flat plate-shaped filament 11 is adjusted by a change in the electric flow path.

In the case of the present embodiment, current flowing between the first leg 12 and the second leg 13 is applied to the outer electron emission surface; current flowing between the first leg 12 and the second leg 13 and current flowing between the third leg 14 and the fourth leg 15 are applied to the inner electron emission surface in the same direction; and the value of current flowing between the first leg 12 and the second leg 13 and the value of current flowing between the third leg 14 and the fourth leg 15 are adjusted. In this manner, the electron emission area is adjusted. The variable resistors 27, 28 are provided in the periphery of the flat plate-shaped filament 11, the variable resistor 27 is electrically connected to the power source 25, and the variable resistor 28 is electrically connected to the power source 26. The power source 25 is a power source for electric flow between the legs 12, 13 (A, B) for full lighting, electrical heating, and the power source 26 is a power source for electric flow between the legs 14, 15 (C, D) for half lighting, electrical heating.

For the value of current of electric flow (the electric flow current), conditions are set so that sufficient electron emission can be obtained with about 9 [A] in the case of distributing power through the legs 14, 15 (C, D) for half lighting, electrical heating. Under such conditions, a current of about 9 [A] flows from the leg 12 (A) for full lighting, electrical heating to the leg 13 (B) for full lighting, electrical heating, and the legs 14, 15 (C, D) for half lighting, electrical heating are set at 0 [A]. Accordingly, electrons are emitted from the entire surface of the electron emission surface 11, resulting in the maximum focus size. This is because a current of 9 A flows through the entire surface of the electron emission surface 11. On the other hand, a current of about 6 [A] flows from the leg 12 (A) for full lighting, electrical heating to the leg 13 (B) for full lighting, electrical heating, and a current of about 3 [A] flows from the leg 15 (D) for half lighting, electrical heating to the leg 14 (C) for half lighting, electrical heating. Thus, a current of 9 [A], which can provide sufficient electron emission, flows through the inner electron emission surface (the region between the base end of D and the base end of C), whereas a current of 6 A, which leads to such a maximum temperature that no electron is emitted, flows through the outer electron emission surface (the region between the base end of A and the base end of D and the region between the base end of C and the base end of B). This results in the minimum focus size.

A current of about 9 [A] to 6 [A] is applied from the leg 12 (A) for full lighting, electrical heating to the leg 13 (B) for full lighting, electrical heating, and a current of about 0 [A] to 3 [A] is applied from the leg 15 (D) for half lighting, electrical heating to the leg 14 (C) for half lighting, electrical heating. In this manner, a current of 9 [A], which can provide sufficient electron emission, flows through the inner electron emission surface (the region between the base end of D and the base end of C). It is assumed that there is a thermal gradient at the flat plate-shaped filament and that the value of current of electric flow and the electron emission area are in a non-linear relationship.

In the case of providing the minimum focus size in such a manner that a current of about 6 [A] is applied from the leg 12 (A) for full lighting, electrical heating to the leg 13 (B) for full lighting, electrical heating and that a current of about 3 [A] is applied from the leg 15 (D) for half lighting, electrical heating to the leg 14 (C) for half lighting, electrical heating, the electron emission area can be ensured at least at the inner electron emission surface in such a manner that a current of about 9 [A] to 6 [A] is applied from the leg 12 (A) for full lighting, electrical heating to the leg 13 (B) for full lighting, electrical heating and that a current of about 0 [A] to 3 [A] is applied from the leg 15 (D) for half lighting, electrical heating to the leg 14 (C) for half lighting, electrical heating. Depending on each current value within the above-described range, the electron emission area is finely adjusted within the area from the inner electron emission surface to the outer electron emission surface. Thus, the focus size is adjustable to the size between the maximum and minimum focus sizes.

Thus, the high-voltage generator 5 (see FIG. 1) simultaneously controls the variable resistors 27, 28 to be synchronized with each other, thereby setting the value of current flowing through the variable resistor 27 to about 9 [A] to 6 [A] and setting the value of current flowing through the variable resistor 28 to about 0 [A] to 3 [A]. Thus, the variable resistor 27 adjusts current flowing through the legs 12, 13 (A, B) for full lighting, electrical heating to a current value of 9 [A] to 6 [A], and the variable resistor 28 adjusts, in synchronization with such adjustment, current flowing through the legs 14, 15 (C, D) for half lighting, electrical heating to a current value of about 0 [A] to 3 [A].

Note that tables shown in FIGS. 5 (*a*) and 5 (*b*) are preferably prepared before fluoroscopy or shooting. FIGS. 5 (*a*) and 5 (*b*) are the tables showing the correspondence relationship between the electron emission area and the combination between the value of current flowing the legs for full lighting, electrical heating and the value of current flowing the legs for half lighting, electrical heating. Suppose that the maximum focus is obtained with 0.75 [mm], and the minimum focus is obtained with 0.5 [mm]. Before fluoroscopy or shooting, the variable resistors 27, 28 are controlled such that each of the values of current flowing through the variable resistors 27, 28 is set. The emission area at this point is measured, and the current value combination (indicated by "Current Value of A, B" and "Current Value of C, D" in FIGS. 5 (*a*) and 5 (*b*)) and the electron emission area are associated with each other to prepare the tables. FIG. 5 (*a*) is the table for synchronization, the table showing synchronized current values. That is, the current value of A, B and the current value of C, D are each changed. FIG. 5 (*b*) is the table when one of the current values is fixed while only the other current value is variable.

After the tables shown in FIGS. 5 (*a*) and 5 (*b*) are prepared, the high-voltage generator (see FIG. 1) reads, with reference to the tables, the current values corresponding to the electron emission area according to a purpose in fluoroscopy or shooting. The variable resistors 27, 28 are controlled to be set at the read current values, and accordingly, at least one of the values of current flowing through the variable resistors 27, 28 is adjusted.

According to the present embodiment, at least one of the values of current flowing through the plurality of electric flow paths (two electric flow paths in the present embodiment) is adjusted, and therefore, the temperature of part of the region of the filament (the flat plate-shaped filament 11 in the present embodiment) and the temperature of the other part of the region of the filament are properly set. The above-described current value and the electron emission area are in the non-linear relationship. Thus, the current value (s) is adjusted so that the electron emission area of the filament (the flat plate-shaped filament 11) can be freely adjusted. As a result, an optional degree of focus between the focus obtained in the case of entire heating and the focus obtained in the case of partial heating can be obtained.

In the method for adjusting the filament according to the present embodiment, the values of current flowing through the plurality of electric flow paths (two electric flow paths) are preferably synchronized and adjusted with reference to, e.g., the table shown in FIG. 5 (*a*). Needless to say, the current values are not necessarily synchronized with each other, and may be separately adjusted with reference to, e.g., the table shown in FIG. 5 (*b*).

The present invention is not limited to the above-described embodiment, and the following variations can be employed.

(1) The specific configuration of the X-ray tube assembly using the filament is not limited. For example, the present invention is applicable to a rotary envelope type medical X-ray tube configured such that an anode and an envelope housing the anode rotate together, other types of medical X-ray tube, and a large focus X-ray tube for industrial use.

(2) In the above-described embodiment, the present invention is applied to the X-ray tube assembly. However, the present invention may be applied to an electron source configured to emit an electron beam without generating an X-ray.

(3) The X-ray apparatus may be a medical X-ray apparatus configured to diagnose a subject or an industrial X-ray apparatus used for a non-destructive testing apparatus.

(4) In the above-described embodiment, the case of using the filament (the flat plate-shaped filament in the embodiment) for the X-ray tube assembly has been described as an example, and the example of incorporating the X-ray tube assembly into the X-ray apparatus such as the X-ray fluoroscopic apparatus and the X-ray equipment has been also described as the example. However, the same applies to the case of adjusting only the X-ray tube assembly or the filament.

(5) In the above-described embodiment, the flat plate-shaped filament has been described as an example, but the electron beam emission surface is not necessarily in a flat plate shape. Note that the flat plate-shaped filament having the flat plate-shaped electron beam emission surface can be more easily fixed along the horizontal plane, and therefore, the focus can be more precisely controlled.

(6) In the above-described embodiment, the filament (the flat plate-shaped filament in the embodiment) includes two electric flow paths. However, as long as the filament includes a plurality of distribution paths, the filament may include three or more electric flow paths. For example, as illustrated in FIG. 4 of Patent Document 1: JP-A-2012-015045, the filament including three electric flow paths may be applied. That is, the filament includes at least two electric flow paths. The filament at least includes first to fourth legs for electrical heating, an outer electron emission surface electrically connected to the first and second legs, and an inner electron emission surface electrically connected to the third and fourth legs and the outer electron emission surface. An adjuster causes current flowing between the first and second legs to flow through the outer electron emission surface, and causes current flowing between the first and second legs and current flowing between the third and fourth legs to flow through the inner electron emission surface, thereby adjusting at least one of the value of current flowing between the first and second legs or the value of current flowing between the third and fourth legs.

(7) In the above-described embodiment, the adjuster is the variable resistors 27, 28. However, as long as the configuration is made to adjust the current value (s), the adjuster is not limited to the variable resistor. For example, a capacitance (electrostatic capacitance) or a reactance may be employed as the adjuster. In addition, the primary current of a voltage converter (a transformer) may be adjusted such that the secondary current of electric flow to the flat plate-shaped filament 11 is adjusted.

(8) In the above-described embodiment, the configuration for synchronization is employed for (the synchronizing circuit of) the high-voltage generator 5. However, as long as the configuration is made to synchronize and adjust the current values, the configuration for synchronization is not limited to the high-voltage generator 5. Alternatively, synchronization may be performed according to a trigger.

INDUSTRIAL APPLICABILITY

As described above, the present invention is suitable for the X-ray apparatus such as the X-ray fluoroscopic apparatus and the X-ray equipment.

DESCRIPTION OF REFERENCE SIGNS

2 X-ray tube assembly
3 flat panel type X-ray detector (FPD)
4 image processor
5 high-voltage generator
11 flat plate-shaped filament
22 cathode
27, 28 variable resistor

The invention claimed is:

1. An X-ray tube assembly for generating an X-ray, comprising:

a filament including a plurality of electric flow paths; and an adjustor configured to adjust at least one of values of current flowing through the plurality of electric flow paths, by varying a non-zero current value of the at least one of values of current flowing through the plurality of electric flow paths, to adjust an electron emission area of the filament.

2. The X-ray tube assembly according to claim 1, wherein the filament includes first to fourth legs for electrical heating, an outer electron emission surface electrically connected to the first and second legs, and an inner electron emission surface electrically connected to the third and fourth legs and the outer electron emission surface, and the adjuster causes current flowing between the first and second legs to flow through the outer electron emission surface, causes the current flowing between the first and second legs and current flowing between the third and fourth legs to flow through the inner electron emission surface, and adjusts at least one of a value of the current flowing between the first and second legs and a value of the current flowing between the third and fourth legs.

3. The X-ray tube assembly according to claim 2, wherein the current flowing between the first and second legs and the current flowing between the third and fourth legs flow through the inner electron emission surface in an identical direction.

4. A method for adjusting an electron emission area of a filament including a plurality of electric flow paths, comprising:

an adjustment step of adjusting at least one of values of current flowing through the plurality of electric flow paths, by varying a non-zero current value of the at least one of values of current flowing through the plurality of electric flow paths, to adjust the electron emission area of the filament.

5. The method according to claim 4, wherein the filament includes first to fourth legs for electrical heating, an outer electron emission surface electrically connected to the first and second legs, and an inner electron emission surface electrically connected to the third and fourth legs and the outer electron emission surface, and the adjustment step causes current flowing between the first and second legs to flow through the outer electron emission surface, causes the current flowing between the first and second legs and current flowing between the third and fourth legs to flow through the inner electron emission surface, and adjusts at least one of a value of the current flowing between the first and second legs and a value of the current flowing between the third and fourth legs.

6. The X-ray tube assembly according to claim 1, wherein the adjustor adjusts at least one of values of current flowing through the plurality of electric flow paths among plurality of values greater than or equal to three values.

7. The X-ray tube assembly according to claim 1, wherein the adjustor adjusts values of all current flowing through the plurality of electric flow paths.

8. The method according to claim 4, wherein the adjustment step adjusts at least one of values of current flowing through the plurality of electric flow paths among plurality of values greater than or equal to three values.

9. The method according to claim 4, wherein the adjustment step adjusts values of all current flowing through the plurality of electric flow paths.

10. The X-ray tube assembly according to claim 1, wherein the adjuster includes at least one variable resistor controlled to vary the non-zero current value.

11. The method according to claim 4, wherein the non-zero current value is varied using a variable resistor.

* * * * *